United States Patent [19]

Corrado et al.

[11] 3,985,058

[45] Oct. 12, 1976

[54] SELF-SEALING FLUIDIC EXPLOSIVE INITIATOR

[75] Inventors: Anthony P. Corrado, Totowa Boro; Frank Timte, Budd Lake; Edward L. Rakowsky, Kinnelon; Vincent P. Marchese, Morris Plains; Charles W. Bing, Irvington, all of N.J.

[73] Assignee: The United States of America as represented by the Secretary of the Army, Washington, D.C.

[22] Filed: Aug. 8, 1975

[21] Appl. No.: 603,210

[52] U.S. Cl. ..... 89/1 B; 102/81

[51] Int. Cl.[2] ..... F42C 5/00

[58] Field of Search ..... 102/81, 86.5, 16, 45; 89/1 B

[56] References Cited

UNITED STATES PATENTS

| | | | |
|---|---|---|---|
| 2,892,452 | 6/1959 | Weinstock | 89/1 B X |
| 3,112,670 | 12/1963 | Litz | 89/1 B |
| 3,133,408 | 5/1964 | Stott | 89/1 B X |
| 3,202,162 | 8/1965 | Eckardt et al. | 89/1 B X |
| 3,630,150 | 12/1971 | Rakowsky | 89/1 B X |
| 3,630,151 | 12/1971 | Rakowsky | 102/81 X |
| 3,672,300 | 6/1972 | Axelson et al. | 102/81 X |
| 3,854,401 | 12/1974 | Fisher | 102/81 X |
| 3,858,392 | 1/1975 | Evans et al. | 89/1 B X |
| 3,863,571 | 2/1975 | Campagnuolo et al. | 102/81 |

*Primary Examiner*—David H. Brown
*Attorney, Agent, or Firm*—Nathan Edelberg; A. Victor Erkkila; Max Yarmovsky

[57] ABSTRACT

A self-sealing fluidic explosive initiator utilizes a tapered sliding inner sleeve, having a nozzle element, resonance tube and an explosive charge proximately disposed adjacent the resonance tube, to mate with a fitting sleeve for terminating a gas supply flow to the nozzle, and for containing the products of explosion of the initiator upon activation of the explosive charge. The initiation of the explosive charge is used to move a piston cutter valve.

2 Claims, 2 Drawing Figures

SELF-SEALING FLUIDIC EXPLOSIVE INITIATOR

GOVERNMENTAL INTEREST

The invention described herein was made in the course of a contract with the Government and may be manufactured, used and licensed by or for the Government for governmental purposes without the payment to us of any royalty thereon.

BACKGROUND OF THE INVENTION

Various means have been used in the past to activate an explosively actuated valve. The problem with prior art devices has been that the initiation of the explosive charge generally required either an electrically operated squib, a spring loaded firing pin to initiate a primer either manually or remotely, or an inertia or environmental means to trigger an actuating mechanism. These aforementioned types of initiating means were generally cumbersome to install, often too large to use in confined spaces, expensive to produce, and in some instances lacked the ability to act without significant delay or expended substantial energy. Another problem with prior art devices used to initiate explosive valves was their inability to contain the products of combustion used to initiate the explosive valve. A further problem with prior art flueric initiated devices was their inability to rapidly cut off the supply of the fluid power source.

SUMMARY OF THE INVENTION

This invention relates to a self-sealing fluidic explosive initiator which has the capability of rapidly terminating a gas supply flow after initiation and containing the products of the explosion/combustion. Actuation of an explosive valve is achieved by the utilization of a sliding sleeve which incorporates a venturi nozzle, a resonance tube and an explosive charge in axial alignment with a piston having an integral ram attached thereto. The sleeve is free to slide and swage shut the device upon activation of an exlosive charge. In one embodiment of the invention (not shown) a valve, in close proximity to the piston ram, is activated when a small quantity of explosive in the initiator is ignited in a closed chamber adjacent to the movable piston. The ram in the aforedescribed embodiment is used to knock off a closure seal off of a gas storage bottle, thereby allowing the bottle to open and gas to flow into an attached system. The self-sealing fluidic explosive initiator is capable of generating temperatures as high as 1000° C. in 10–25 milliseconds, then, in less than 100 milliseconds, it can shut off its own source of fluid supply after it has performed its function with a resultant gas consumption of approximately less than 0.03 cubic feet.

An object of the present invention is to provide a self-sealing fluidic explosive initiator which cuts off its own gas supply flow.

Another object of the present invention is to provide a self-sealing fluidic explosive initiator which cuts off its own gas supply flow and contains the products of combustion of an explosively operated valve.

Another object of the present invention is to provide a self-sealing fluidic explosive initiator which can generate temperatures of approximately 1000° C. in 10–25 milliseconds.

Another object of the present invention is to provide a self-sealing fluidic initiator which is capable of cutting off its own source of fluid supply in less than 100 milliseconds.

A further object of the present invention is to provide a self-sealing fluidic initiator which cuts off its own gas supply flow in less than 100 milliseconds, can generate 1000° C. in approximately 10–25 milliseconds, contains the products of combustion of an explosively operated valve, operates with a 200 pounds per square inch gauge input gas supply and has a gas consumption of about 0.03 cubic feet at standard atmospheric pressure.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 1:
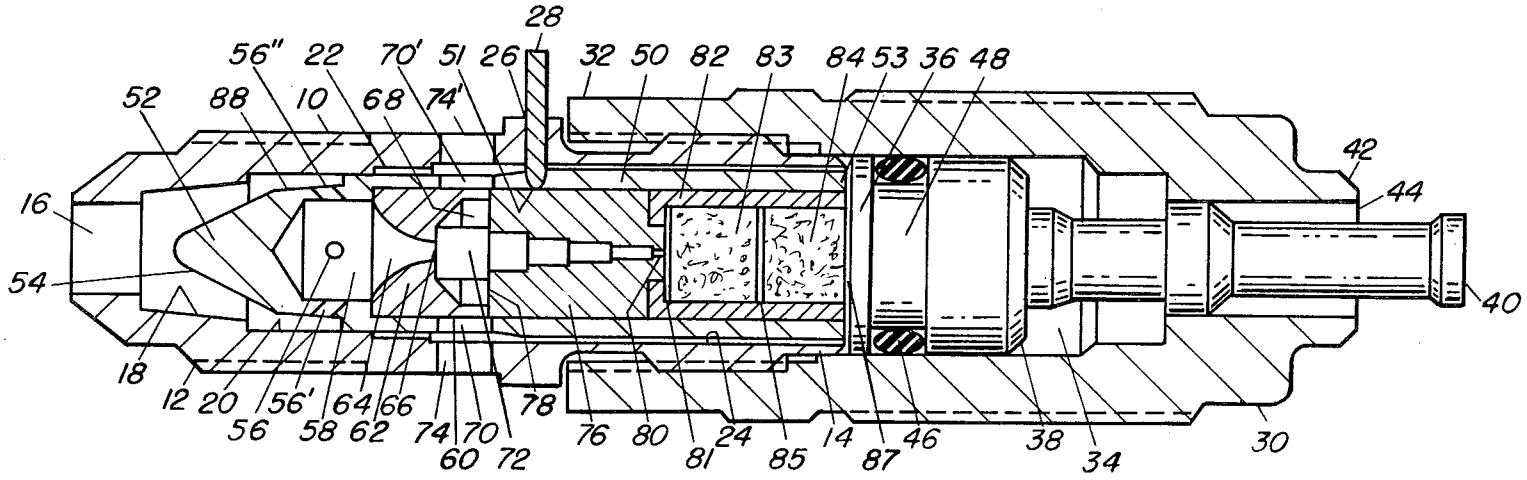
FIG. 1 is a partial diametral longitudinal cross-sectional view of the self-sealing fluidic explosive initiator mated with a cutter valve in a "before firing" position.

Referring now to FIG. 1 a tubularly shaped fitting sleeve 10 made of such material as AISI 303 stainless steel, has an externally threaded front end 12 and an externally threaded rear end 14. The front end 12 has an axial input bore 16 which communicates with a tapered axially aligned counterbore 18 which in turn communicates with a first axial counterbore 20, a second axial counterbore 22 and a third axial counterbore 24 which exits from rear end 14. A transversely positioned shear pin bore 26 holds a shear pin 28 therein. An explosive cutter valve housing 30 is threadedly fixed on its internally threaded forward end 32 to the externally threaded rear end 14 of fitting sleeve so that the rear end 14 of fitting sleeve 10 fits into piston axial counterbore 34 and abuts one end 36 of piston 38. The ram end 40 of the piston 38 slidably protrudes out of the valve housing 30 rear end 42 through an axial piston ram exit hole 44. An "0" ring sealing element 46 fits into an annular piston "0" ring groove 48.

Fixedly held in the fitting sleeve 10 by the shear pin 28 is a slidable inner sleeve 50 made of such material as aluminum 2024-T4. Shear pin 28 fits into an inner sleeve shear pin bore 51 and prevents any axial motion between the fitting sleeve 10 and the inner sleeve 50 when the initiator is in its "before firing" position. Inner sleeve 50 has a closed blunt front end 52 and an open rear end 53. The first tapered section 54 is small enough to allow fluids entering input bore 16 to pass through a tapered counterbore 18 into a second counterbore 20 and thence through a plurality of inner sleeve input bores 56, 56' and 56'' which in turn communicates with an axially aligned first inner sleeve plenum counterbore 58. A slightly larger second inner sleeve counterbore 60 is axially aligned with and communicates with the first inner sleeve plenum counterbore 58. Fixedly held within the second inner sleeve counterbore 60 is a nozzle member 62 having a conically shaped orifice 64 whose rear end 66 communicates with a nozzle venting cavity section 68. Nozzle venting cavity 68 communicates with inner sleeve vent holes 70 and 70' through cavity vent slot 72. Nozzle member 62 is shown rotated 90° from its normal position to better illustrate the configuration of the cavity 68 and the vent slot 72. The inner sleeve vent holes 70 and 70' in turn communicate with fitting sleeve vent holes 74 and 74' when the initiator is in its "before firing" position as shown in FIG. 1. Also contained within the second inner sleeve counterbore 60 is a flueric resonance tube 76 which has an input end 78 abutting against the nozzle member 62 and its output end 80 in contact with a cup shaped member 82 which contains an explosive charge 83 and 84 therein.

Figure 2:
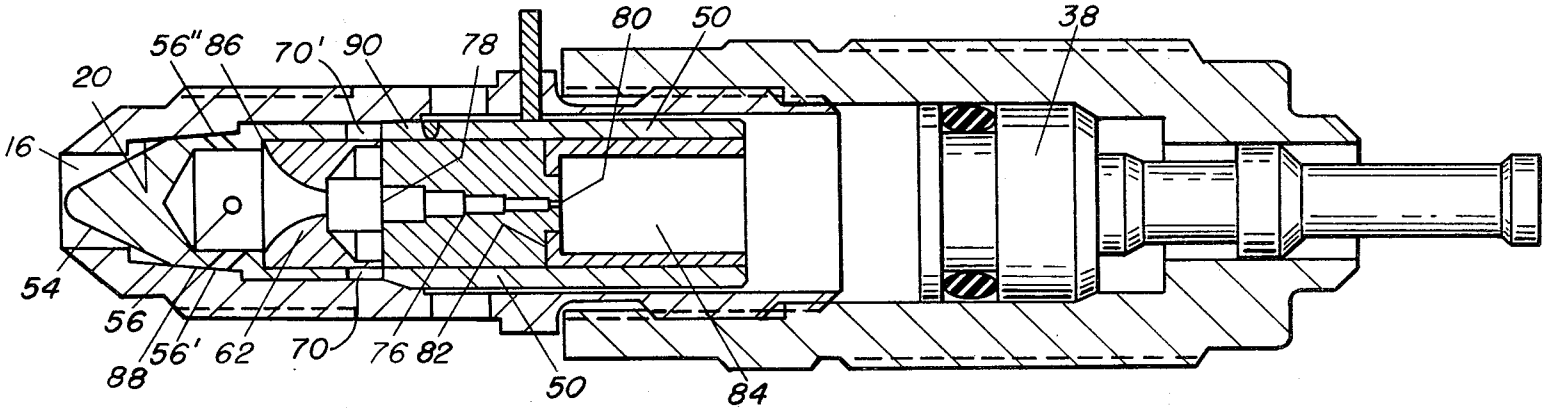
FIG. 2 is a partial diametral longitudinal cross-sectional view of the self-sealing fluidic explosive initiator shown in its after firing position.

Referring now to FIGS. 1 and 2 in operation, when the gas supply flow is introduced into the initiator fitting sleeve input bore 16 at about 200 psi. the gas will flow around the blunt conical section 52 through input sleeve in port bores 56, 56', 56'' and 56''' (not shown) into the nozzle plenum 58. This flow of gas into the input end 78 of the resonance tube 76 causes ignition of a primer charge 83, such as potassium dinitrobenzfuroxan, and an explosive charge 84 in the cup member 82 due to resonance heating in the output end 80 of the stepped tube 76. The explosive aluminum cup member 82 has a partially open front end sealed with a 0.001 inch thick first stainless steel disc 81. The charge layers 83 and 84 are separated by a sealed second stainless steel disc 85 of 0.001 inches thick. The cup member rear end has a 0.001 inch thick aluminum disc ultrasonically welded thereto. The resulting pressure caused by the explosive charge 84 induces a force acting on the cup member 82 which is transmitted in turn to the resonance tube 76, nozzle member 62 and the internal shoulder 86 of the inner sliding sleeve 50. This causes the entire inner sleeve 50 and its contents aforedescribed to break the shear pin 28 and move rapidly toward the gas supply end of the initiator. Rapid motion of the inner sleeve 50 continues until the second inner sleeve tapered section 88 at the blunt conical end 52 of the inner sleeve 50 is swaged into the mating fitting sleeve tapered counterbore 18 thereby effecting a seal at the initiator's supply end. A third inner sleeve tapered section 90 located just beyond the inner sleeve vent holes 70 and 70' simultaneously engages the inner surface of the fitting sleeve, second cylindrical counterbore 22 just before the fitting sleeve vent holes 74, 74'. Prior to motion stoppage of the inner sleeve 50 contact is made at these surfaces and a seal effected at the initiator input end and at vents 74, 74'. The inner sleeve 50 being made from rather ductile aluminum and the outer sleeve fitting 10 being made from stainless steel insures a good seal against pressures from both the supply end and the piston valve end 38. The expanding gases of the explosive charge 84 simultaneously cause the piston 38 to move from its retracted position shown in FIG. 1 to its extended actuating position shown in FIG. 2.

The foregoing disclosure and drawings are merely illustrative of the principles of this invention and are not to be interpreted in a limiting sense. We wish it to be understood that we do not desire to be limited to the exact details of construction shown and described for obvious modifications will occur to a person skilled in the art.

Having thus described the invention, what is claimed as new and desired to be secured by letters patent of the United States is:

1. A self-sealing fluidic explosive initiator which comprises:

housing means having an internally threaded forward end, a rear end having a piston ram exit hole axially positioned therein, and a piston counterbore disposed intermediate said forward end and said rear end;

piston means slidably positioned in said piston counter bore and having a ram end protruding through said ram exit hole; and explosive valve means, threadedly attached to said housing means forward end, for moving said piston means from a retracted position to an extended actuating position for terminating a gas supply flow to said explosive valve means, and for containing the explosive products of said explosive valve means after initiation of said piston means, which includes;

a fitting sleeve having an axial input bore in a front end, an externally threaded rear end, a tapered axially aligned counterbore which communicates with said input bore, a first cylindrical axially aligned counterbore which communicates with said tapered counterbore, a second cylindrical axially aligned counterbore communicating with said first counterbore, a third cylindrical axial counterbore which communicates with said second cylindrical counterbore, a shear pin bore transversely positioned in said fitting sleeve so that said pin bore communicates with said third cylindrical counterbore, and a plurality of transversely positioned vents which communicate with said third cylindrical counterbore;

an explosive inner sleeve assembly means, slidably positioned in said fitting sleeve, for fluidically generating temperatures as high as 1000° C. in 10–25 milliseconds, and for explosively shutting off a fluid initiating supply source in less than 100 milliseconds; and a shear pin positioned in aid shear pin bore of said fitting sleeve and extending into an inner sleeve shear pin bore for holding said inner sleeve means fixedly attached to said fitting sleeve when said initiator is in a "before firing" position.

2. A self-sealing fluidic explosive initiator as recited in claim 1 wherein said explosive inner sleeve assembly means comprises:

a tubularly shaped inner sleeve member having a closed blunt front end and an open rear end, wherein said blunt front end being smaller than said tapered counterbore of said fitting sleeve allows fluids to enter said fitting sleeve input bore and to pass through said tapered counterbore into said first cylindrical counterbore of said fitting sleeve when said initiator is in a "before firing" position, said front end having an axially aligned plenum counterbore therein, a plurality of input bores which communicate with said plenum counterbore and said first cylindrical counterbore of said fitting sleeve, a second inner sleeve counterbore axially aligned with said plenum counterbore and communicating therewith;

a nozzle means fixedly disposed and axially aligned in said second inner sleeve counterbore;

a flueric resonance tube in axial alignment with said nozzle being fixedly positioned in said second inner sleeve counterbore having an input end and an output end, said input end abutting against said nozzle member;

a cup means having an explosive charge therein being fixedly positioned in said second inner sleeve counterbore so that said cup member is against the output end of said resonance tube;

wherein said explosive valve means operates with a gas supply of 200 pounds per square inch gauge and has a gas consumption of 0.03 cubic feet at standard atmospheric pressure.

* * * * *